United States Patent [19]

Suey

[11] Patent Number: 4,597,341

[45] Date of Patent: Jul. 1, 1986

[54] SOAKING PIT COVER

[76] Inventor: Paul V. Suey, 1043 Blackforest Rd., Pittsburgh, Pa. 15235

[21] Appl. No.: 736,670

[22] Filed: May 22, 1985

[51] Int. Cl.[4] ..... F23M 7/00

[52] U.S. Cl. ..... 110/173 A; 432/250

[58] Field of Search ..... 110/173 R, 173 A, 331, 110/332, 333, 334; 432/250

[56] References Cited

U.S. PATENT DOCUMENTS

| | | | |
|---|---|---|---|
| 693,252 | 2/1902 | Fiske . | |
| 1,582,275 | 4/1926 | Kellner | 110/334 |
| 2,091,224 | 8/1937 | Brinckerhoff et al. . | |
| 2,178,668 | 11/1939 | Longenecker . | |
| 2,791,191 | 5/1957 | Guthrie | 110/173 A |
| 2,792,795 | 5/1957 | Herman | 110/173 A |
| 3,375,315 | 3/1968 | Gray . | |
| 3,853,077 | 12/1974 | Malovich . | |
| 4,097,228 | 6/1978 | Rosling . | |
| 4,162,891 | 7/1979 | Fellnor et al. . | |
| 4,183,305 | 1/1980 | Payne . | |
| 4,210,086 | 7/1980 | Smith, Jr. et al. . | |

*Primary Examiner*—Edward G. Favors

*Attorney, Agent, or Firm*—Parmelee, Miller, Welsh & Kratz

[57] ABSTRACT

A lightweight, refractory soaking pit cover is formed from a plurality of trapezoidally shaped modules, with adjacent modules positioned wide-face-up and wide-face-down, and contained within a periphery of higher density rim blocks. The rim blocks and wide-face-down modules are attached to a structural steel frame, while the wide-face-up modules rest by gravity on the edges of the rim blocks and wide-face-down modules. The modules are readily replaceable and provide a lightweight construction and good insulation properties.

9 Claims, 12 Drawing Figures

SOAKING PIT COVER

This invention relates to soaking pits and particularly to a cover for soaking pits.

Soaking pits are widely used in the steel and steel-working industries. As the name implies, they are pit-like structures, having a bottom, side, and end walls, and they are generally rectangular in shape. They are designed for the heating of massive pieces of steel such as, for example, steel ingots, from the outside to the center to a hot rolling temperature. To accomplish this kind of heating, the workpiece must be enveloped in flames and hot gases for at least several hours to "soak" up the heat and, for practical purposes, become substantially uniformly heated from top to bottom.

The pits are provided with covers which, during the heating cycle, sit on the level tops of the side and end walls to prevent, as much as possible, the escape of heat or gases from the furnace. The covers are raised and then lowered onto the pit. This cover is a particularly vulnerable part of the soaking pit, because of the up and down and back and forth movements, and exposure to changing temperature, which causes refractory shock. Also while hot, the cover sometimes suffers impact from workpieces being charged into the pit or removed therefrom. In addition, the cover is the highest and hottest part of the enclosure and, if there is an impact seal with the top surface of the it walls, its metal frame is subject to distortion from escaping flame and hot gases. The cover's very size and weight alone introduce mechanical stresses. A moderate-size cover requires many tons of refractory to which must be added the many tons of structural steel required to give it rigidity. The maintainence and repair of these covers is a frequent problem, and a group or battery of smaller pits is used to assure that a plant production schedule may be maintained in the event one or two soaking pits may be out of operation because of repairs. It may be pointed out here, also, that failure of a pit cover to afford adequate insulation or prevent escape of furnace gases, or "out lick" of flames, heats the working environment to an uncomfortable temperature and may even create hazards to personnel.

Two general types of seals have heretofore been used between the cover and the top of the soaking pit walls. Perhaps the more widely used is of the type such as disclosed in Longnecker U.S. Pat. No. 2,178,668, where the rim of the cover has a depending metal flange, and the top of the pit wall has a peripheral trench which is filled with sand. When the cover is lowered, the flanges enter the trench, displacing the sand which forms a seal with the flange. This is commonly referred to as a "sand seal". The other type is disclosed in Brinckerhoff, et al. U.S. Pat. No. 2,091,224. In this patent there is a rim of dense refractory blocks suspended from the steel frame of the cover. These blocks have flat bottom surfaces that rest on the level top surfaces of the pit walls. Loose sand may be sprinkled over the surface of the pit walls. This general type of "rim" seal is disclosed in the present application but with important improvements. Both of the foregoing patents, like the present invention, disclose a cover comprising a flat refractory arch suspended from a structural steel frame, but the present application discloses an improved construction in which each block, including the rim blocks, contributes to the support of one another instead of each refractory block or unit being independently suspended from a part of the structural steel frame.

BRIEF DESCRIPTION OF THE INVENTION

The present invention, in contrast to using an integral large refractory casting over the entire area of the cover, or the more prevalent practice of suspending small, individually pressed and fired refractory bricks, employs individually cast refractory modules or panel-like blocks of low density or lightweight refractory material wherein, by dovetailing one with another, every other module, at most, has direct support from the metal frame. Less than one hundred refractory modules are required for a cover panel for a soaking pit having wall to wall dimensions 23 feet in length and 8½ feet in width, and with less than half of all of the modules so used being directly suspended from the steel frame. Moreover, any individual module may be replaced with little or no disturbance of other modules. The present invention not only provides an improved cover of lighter steel construction but also one in which the steel structure is better protected from direct exposure to hot furnace gases.

BRIEF DESCRIPTION OF THE DRAWINGS

The invention may be better described and understood by reference to the accompanying drawings, in which.

DETAILED DESCRIPTION

Figure 1:
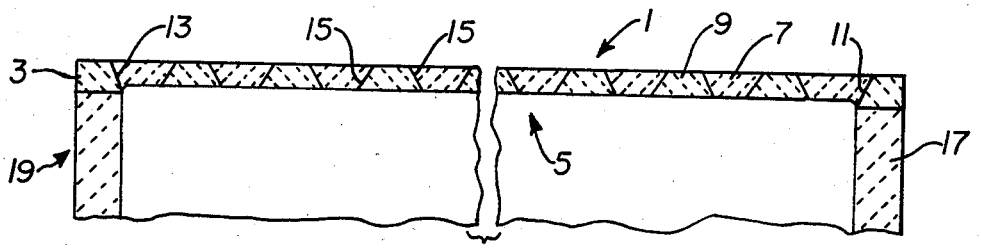
FIG. 1 is a fragmentary view representing only the relation of the refractory areas of the cover and the side walls of the soaking pit, all steel elements being omitted, the view showing the dovetailing of the refractory modules of the cover in place.

FIGS. 1 to 4 show only the general features to which the remaining figures are, in a sense, ancillary. It is quite usual in soaking pit covers that the rim of the cover be formed as dense, strong refractory because it is the rim of the cover that is subject to impact and destruction incidents such as the shock which these blocks encounter when the cover is lowered onto the soaking pit walls, and abrasive action of rubbing over sand and irregularities in the material of which the walls are formed. These rim blocks are most frequently struck by heavy objects being lowered into the soaking pit by an overhead crane or by such objects being lifted from the soaking pit. The area of the inside of the rim is generally constituted of much less dense or strong refractory. Generally, they are relatively small units formed by pressure molding the clay or mix from which they are made. Not uncommonly, they are suspended in clusters from metal bars carried by the roof structure.

In the present invention a soaking pit cover 1 has a rim of dense, heavy blocks around the perimeter of the cover 1, used over the entire area of the cover. As here shown, the rim blocks 3 are wider at their base than at the top. The outside face of each block is vertical but the inner face slopes downwardly and inwardly toward the interior of the soaking pit. Corner pieces are formed of two similar sections joined at right angles, so that this angular face is continuous around the interior of the rim.

All the refractory modules forming the panel 5 of the cover within the periphery of the rim blocks 3 are preferably relatively large cast refractory bodies of the same length and, as here shown, are of the same width as the rim blocks 3; but, as hereinafter will appear, their width may be smaller. The modules of the panel 5 are designated 7 and 9. It will be seen from the figures that they are all of trapezoidal section lengthwise and crosswise with the side faces of the blocks all sloped at the same angle; but they are alternated endwise and crosswise, module 7 having its wider face turned upwardly and module 9 having its wider face turned downwardly, so that they dovetail lengthwise and crosswise with each other and also with the inner faces of the rim blocks 3. All modules may be the same size with abutting modules reversed, except as will hereinafter appear. Modules 9, wide-face-down, have hardware on their upper sufaces (not shown in FIG. 1) by which they are suspended from an overhead structural frame.

Because of the slope of the inner faces of the rim blocks 3, all of the low density modules to be placed alongside the rim blocks 3, with their ends contacting the rim blocks 3, will be wide-face-up modules 7. In this way the slope of the contacting side 11, or end edges, of the insulating modules 7 will dovetail with, and their outer perimeters will be supported directly on, the sloping inner face 13 of the rim blocks 3. The overlapping sloping edges 15 of contiguous modules are constantly urged into face-to-face contact by gravity, closing any vertical crevices through the cover, and there is a comparable thickness of insulation at the joints as elsewhere in the low density area of the cover. By reverse bevel of mating corners of modules inside the rim, as hereinafter described, the modules will nest even closer and tighter together.

With the foregoing general explanation, the actual construction of the pit cover may now be explained.

Figure 2:
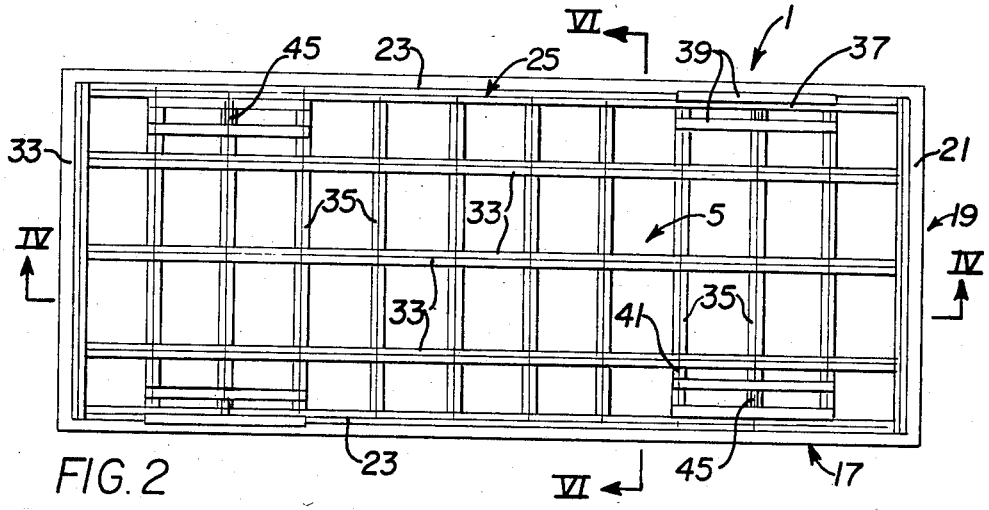
FIG. 2 is a top plan view of the cover structure, with the outline of the pit on which it sets being shown in heavy lines.
Figure 11:
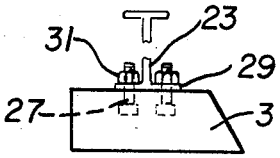
FIG. 11 is an enlarged detail section of that portion of the roof structure indicated by the dotted circle XI in FIG. 3.

FIG. 2 is a plan view of a cover 1 shown in position on the walls 17 of a soaking pit 19 as indicated by the surrounding heavy line in this figure. As previously explained, rim blocks 3 of the cover 1 rest on the top surfaces 21 of the walls 17. These rim blocks 3 are attached to and suspended from marginal I-beam sections 23 of a steel frame structure 25. It may be seen in FIG. 3–6 that the rim blocks 3 are of trapezoidal shape as viewed from the side and they are arranged in alternating sequence of short dimension up and short dimension down around the frame. FIG. 11 shows in detail how the rim blocks are secured to the marginal beams 23 of the frame structure 25, FIG. 11 being an enlargement of that area XI of FIG. 3 outlined by a dotted circle. As shown, the rim blocks 3 have two bolts 27, spaced side by side, embedded head down in the refractory of which the rim block 3 is comprised. The bolts 27 are preferably so spaced that their threaded upstanding ends may pass through predrilled holes 29 in the base flanges of I-beam sections 23. Nuts 31, as shown, are screwed on the bolts 27 to clamp the top surface of the rim block 3 tight against the bottom flange of the beam 23. Only the small end-up rim blocks need be secured in this way, as they will frictionally hold the large end-up rim blocks in place. As hereinbefore more fully explained, the inner faces of the rim blocks 3 are in contact with the marginal sides or ends of the modules 7 so that this combination in the trapezoidal shapes of the rim blocks 3 have dovetailing end surfaces and their close contact with edges of the adjacent insulating modules 7 of the cover effectively reduces escape of furnace gases from the rim area of the cover 1.

Referring further to FIG. 2, the structural steel frame 25 has, in addition to marginal frame sections 23, a plurality of continuous parallel I-beam sections 33 spanning the length of the frame from marginal end section 23 at one end to marginal end section 23 at the other. There are discontinuous or sectional cross beams 35 extending at equally spaced intervals from one side frame section 23 to the other side frame section 23. Being in the same plane as sections 33, sections 35 are formed of aligned sections, each section of which extends from the web of the next longitudinal section 33, with the sections 35 of each set of sections terminating at the web of side frame members 23. Although the cross beams 35 are discontinuous in the sense that they are comprised of end to end sections, they function for all purposes of this invention as continuous structural units.

Figure 3:
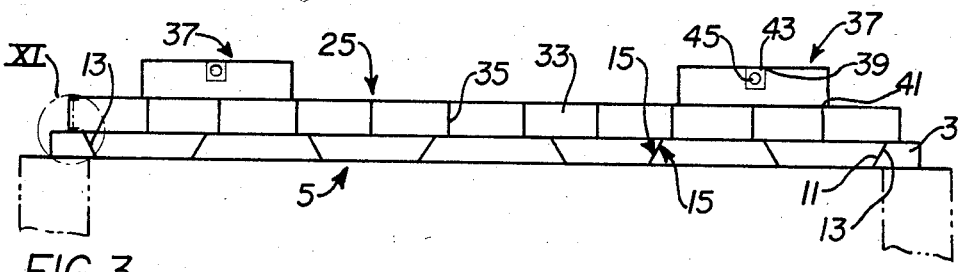
FIG. 3 is a side elevation of FIG. 2.
Figure 4:
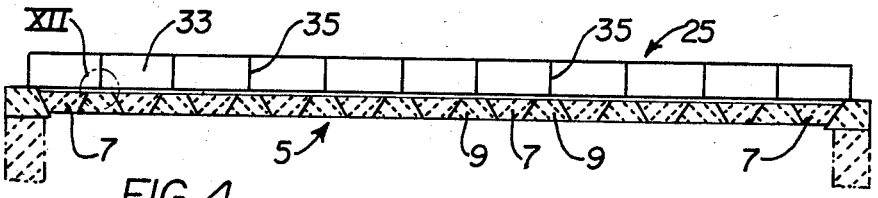
FIG. 4 is a longitudinal section taken along lines IV—IV of FIG. 2.
Figure 5:
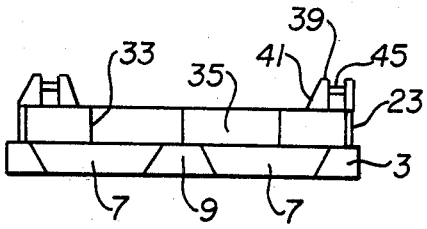
FIG. 5 is an end elevation of FIG. 2, looking from the left.

As best seen in FIG. 3 in conjunction with FIG. 2, lifting hook assemblies 37 are provided near each of the four corners of the frame 25. These lugs, or hook assemblies 37, each comprise two short, spaced, parallel I-beam sections 39 welded to the top flanges 41 of a plurality of the cross beams 35. At the outer surfaces of the webs of sections 39 of each assembly are braces or gussets 43. There is a cross pin 45 extending through the confronting webs of the I-beam section 39 so that a lifting hook on each corner of a conventional lifting frame (not shown but as commonly used in soaking pit operations) may hook the respective cross pins 45 to first lift the frame and then move it horizontally from over the soaking pit, an operation required for placing workpieces in the soaking pit or removing hot pieces from the soaking pit.

Figure 7:
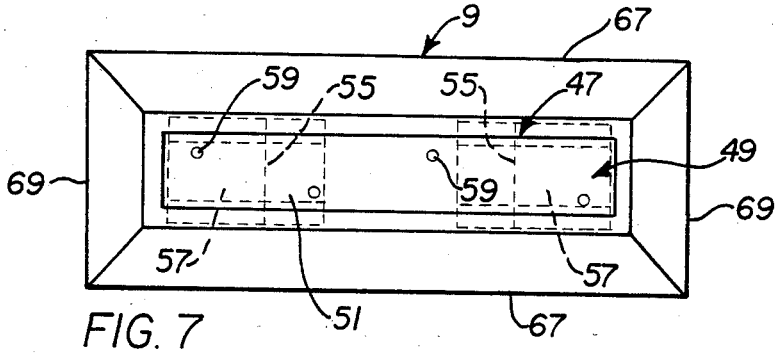
FIG. 7 is a detailed plan view of one of the wide-face-down blocks or modules with hardware.
Figure 8:
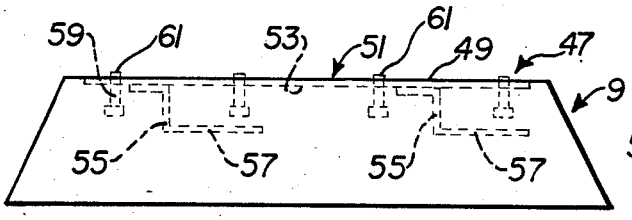
FIG. 8 is a side elevation of the block shown in FIG. 7.
Figure 9:
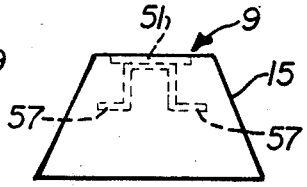
FIG. 9 is an end view of the block shown in FIG. 7.

As previously pointed out, the wide-face-down, low-density, high heat insulating modules 9 are suspended from the steel supporting frame and, because of the dovetailing of these modules with the wide-face-up modules 7, they must also support the modules 7 from said steel frame 25. The support of modules 7 is thus effected without any direct connection between the modules 7 and the frame 25. To accomplish this, the modules 9 have hardware of metal integrated therewith. This hardware is shown in FIGS. 7, 8 and 9. In FIG. 7 the module 9 is a low density cast refractory of trapezoidal section crosswise and lengthwise. As indicated, modules of cast refractory may be relatively large as compared to pressed refractory brick. The module 9 illustrated has an actual overall length of $35\frac{1}{8}$ inches and a width of $16\frac{3}{4}$ inches. The particular refractory preferred is a base of aluminum oxide (bauxite) which was initially mixed with a finely divided wood-like flour, of vegetable origin, from which the flour is oxidized in firing to give the mix a minutely porous texture. In the elongate, narrow upper face 47 of the module 9, there is a long narrow central recess 49. In this recess 49 there is a metal strip 51, to the undersurface 53 of which there are welded sheet metal anchor elements 55 that are embedded in the refractory of module 9. As here shown, there are two pairs of anchor elements 55 which are modified Z-shape, with the lower bar 57 of each pair extending laterally into the refractory mass to distribute the tension through a large mass of the entire body. However, none of these anchor elements extends deeply enough into the refractory to be ineffectually removed from the lower face of the block when the furnace is in operation. There are several bolts 59 set head down in the top portion of the refractory module with their shanks 61 passing up through the metal strip 51. In the drawing, four such bolts 59 are shown and are staggered along the strip 51, two to one side of the longitudinal center of the strip 51 and two on the other side, and they are also alternatively arranged lengthwise along the center line of the strip 51.

Figure 6:
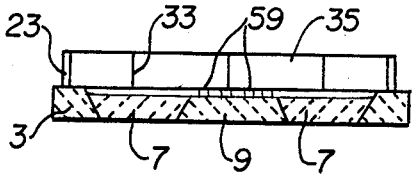
FIG. 6 is a transverse section taken along lines VI—VI of FIG. 2.
Figure 12:
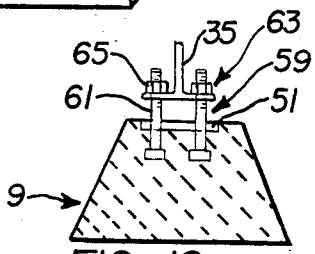
FIG. 12 is an enlarged detailed section of that portion of the roof shown in the dotted circle XII of FIG. 4.

The strip 51 is firmly anchored against relative motion to the module and the position of the bolts 59 relative to the refractory body. The rows of modules 9 are suspended with their long axes at right angles to the long axis of the cover 1. Not considering the rim blocks 3, the first cross row (counting from the left in FIG. 3) comprises wide-face-up modules 7. The modules 7 in this row receive support along one side from the inwardly sloped edges 13 of the rim block 3. Their other side is supported by the first cross row of wide-face-down modules 9, and this row of modules and all other like rows have their long axes centered under the webs of a sectional cross beam 35 of the steel supporting frame 25. As shown in FIG. 12, the shank 61 of bolts 59, passing up through the metal strip 51 also pass through predrilled holes 63 in the base flanges of the sectional cross beam 35. Threaded nuts 65 on the upper ends of bolts 59 suspend the modules 9 in fixed alignment crosswise of the frame 25 with no side or end play. Since rows of modules 7 alternate with the modules 9 and the pattern of modules always has the sides and ends of modules 7 dovetailed with and receiving support from the dense rim blocks 3, there is always one more row of modules 7 crosswise, and lengthwise as well, as there are rows of modules 9. This also holds true crosswise of the soaking pit. There are always more longitudinal rows of modules 7 than there are of modules 9. Referring to FIG. 6, except for the slight projection of the rim blocks 3 over the soaking pit area, there are, in the cover here shown, spanning the full width of the pit, a total of three lengthwise rows of modules all of the same size, two of these being modules 7 and the center row being a module 9. Since there are no bolts on the modules 7, and because of the small scale of the drawing, the four bolts 59 in a module 9, two along each side of the web of the cross beam 35, are schematically represented by short vertical lines.

Any module 7 may be removed and replaced by another one without disturbing any other modules, it being merely a matter of pushing up on a module, turning it edgewise and endwise. The modules 9 may be replaced by merely removing the nuts 65 on the bolts 59, working it from the steel frame with the nuts removed, and dropping it down for replacement by another like block.

By using cast refractory modules of a dimension suited to the dimension of the soaking pit, the weight of the steel frame together with the relatively few pieces will provide an improved cover of less overall weight per unit of dimension with a reduction in heat loss.

Figure 10:
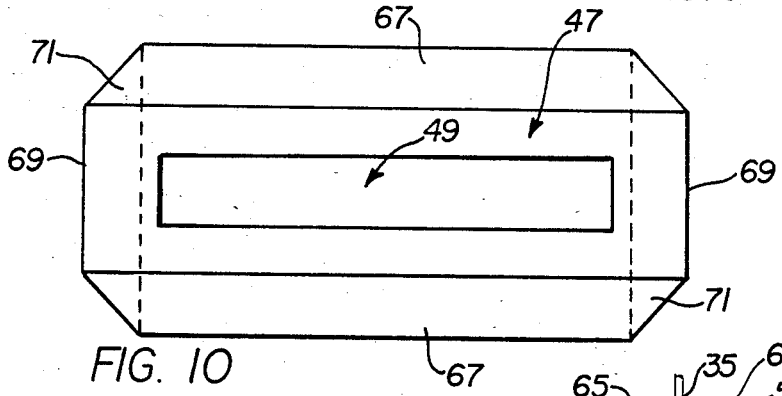
FIG. 10 is a view similar to FIG. 7 of a modified shape of a block, with the four corners of the block beveled so that the block is of trapezoidal section in diagonal plane as well as on the side and end faces.

Returning to the plan view of module 9, FIG. 7, it will be seen that the parallel lines defining the base, that is, the lines marked 67, intersect each of the cross lines 69 marking the terminals of the sloping ends of the module 9 at right angles. Looking at FIG. 10, which is a similar view except that the cross lines 69 are shorter, a three-dimensional corner has been, in effect, sliced away from each of the four corners of this module, imparting a triangular plane 71 to each corner of the module sloping from the vertical at the same angle as the sides and ends of the module. Consequently, when one of two such modules is turned over with respect to the other and their ends brought into overlapping relation, the triangular planes at the meeting corners of the two modules will overlap and increase the effectiveness of the seal between the ends of the modules. This is an embodiment that would not be useful or desirable on the corner of any module showing a surface supported by the inter face 13 of a rim block 3. They might, however, be included elsewhere as module 7 and module 9 units.

In the structure as herein described, various factors cooperate to produce an effective cover construction with usual lifting lugs for use with a present type of cover lifting and moving apparatus, and it may be easily adapted to other such as those that move on wheels. Using large modules of precast lightweight insulation, fewer steel beams lengthwise or crosswise are required in the metal frame, not only reducing the weight but providing open space for removing a defective module and replacing it with another.

I claim:

1. A soaking pit cover comprising a rectangular structural steel frame comprised of spaced intersecting sections, with rim sections defining a rectangle of a length and width to extend across the area of a soaking pit and project over the side and end walls of the soaking pit, containing:

a continuous panel of lightweight, high temperature heat-insulating refractory modules suspended from the structural steel frame over an area substantially coextensive with the area of the soaking pit defined by said side and end walls;

said panel formed from modules of trapezoidal cross-section lengthwise and crosswise, the sloping side and end edges of the trapezoidal, respectively, being equal with each other and with the edges of the side and end walls, respectively, of the other modules whereby the modules each have one face, of a wider and larger area, respectively, than the other;

the modules of the panel being arranged in rows crosswise and lengthwise of the structural frame dovetailing with its adjacent blocks, with the modules in alternate rows being wide-face-up and wide-face-down, and in the intervening rows being reversed;

the wide-face-down modules having metal hardware integrated with the body of the modules by means of which they are connected with and suspended from the underside of said steel frame, the wide-face-up modules being suspended at least in part between and supported in place by their dovetail intermesh with the wide-face-down modules.

2. The soaking pit cover defined in claim 1 wherein there is a rim of dense, wear-resistant, heavy refractory blocks suspended directly from the perimeter of said rectangular structural steel frame, the inner faces thereof sloping downwardly and inwardly toward the interior of the soaking pit, at an angle matching the angular slope of the edges of said trapezoidal modules, whereby wide-face-up modules at the sides and ends of the refractory panel dovetail with the inner faces of the rim blocks.

3. The soaking pit cover defined in claim 2 in which the rim blocks are in the shape of alternate reversed trapezoids in the direction of the length of the frame member from which they are suspended so that they dovetail with each other.

4. The soaking pit cover defined in claim 1 wherein the structural steel frame within the rim comprises spaced continuous parallel I-beam sections extending lengthwise of the frame and joined sectional I-beam assemblies extending crosswise of the frame with the bases of both sections substantially in a common plane.

5. The soaking pit cover as defined in claim 4 in which both the wide-face-up and wide-face-down modules have their long axes extending crosswise of the frame, with each cross row of wide-face-down modules being centered under and suspended at least in part from a sectional cross beam, the wide-face-up modules alternating with the rows of wide-face-down modules, and with wide-face-up modules dovetailing between and being supported in part by the wide-face-down modules.

6. The soaking pit cover as defined in claim 1 in which the corners of all modules where they confront the corners of three other modules have the corner areas shaped to planes which have the same angle of slope as the sides and ends of the same module, but in a plane at a 45° angle to the intersecting side and end walls of the same module.

7. A soaking pit cover having a structural steel frame of a length and width to extend over a soaking pit, comprising a rim of dense refractory blocks suspended from the frame, the inner faces of all the rim blocks having an inward and downward slope toward the interior of the pit, a continuous panel of lightweight, heat insulating modules in the area surrounded by the rim blocks, all of the marginal blocks of the panel dovetailing with the rim blocks and with each other.

8. A soaking pit cover as defined in claim 7 in which the modules are of trapezoidal section lengthwise and crosswise, with opposite parallel upper and lower planar surfaces, one of which has a larger area than the other, the dovetailing being effected by alternating the modules, crosswise and lengthwise of the roof structure wide-face-up and wide-face-down.

9. A rectangular soaking pit cover comprising a frame comprising structural side and end members, said members each having a vertical web and a base flange extending outwardly and inwardly therefrom, a succession of dense refractory rim blocks having flat top surfaces flush against the bottom of the base flange, with bolts embedded head down in the dense refractory and which project upwardly from the top of said rim blocks, the bolts having threaded ends passing through openings in the base flange of the structural members, with nuts on the bolts above the flange clamping the rim blocks to the undersurface of the base flange, said rim blocks in transverse section being wider at their base which, when the cover is in place over a soaking pit, have a flush contact with the top surface of the soaking pit walls, the inner edge surfaces of said rim blocks sloping downwardly and inwardly toward the pit to provide a continuous refractory surface around the interior of the rectangular frame, a panel of interfitting low density high insulating modules within said structural frame, with which the rim blocks make a dovetail surface-to-surface contact, whereby the rim blocks give support to contacting edges of peripheral modules comprising said panel.

* * * * *